US009833755B2

(12) United States Patent
Mothersbaugh et al.

(10) Patent No.: US 9,833,755 B2
(45) Date of Patent: Dec. 5, 2017

(54) SYSTEM FOR MIXING/BLENDING FINE BULK MATERIALS

(71) Applicant: THE YOUNG INDUSTRIES, INC., Muncy, PA (US)

(72) Inventors: James E. Mothersbaugh, Muncy, PA (US); Curtis Wykoff, Hughesville, PA (US); Joseph Anthony Hauser, Williamsport, PA (US)

(73) Assignee: THE YOUNG INDUSTRIES, INC., Muncy, PA (US)

( * ) Notice: Subject to any disclaimer, the term of this patent is extended or adjusted under 35 U.S.C. 154(b) by 252 days.

(21) Appl. No.: 14/722,322

(22) Filed: May 27, 2015

(65) Prior Publication Data

US 2016/0346745 A1 Dec. 1, 2016

(51) Int. Cl.

| | |
|---|---|
| ***B01F 3/18*** | (2006.01) |
| ***B01F 5/10*** | (2006.01) |
| ***B01F 5/24*** | (2006.01) |
| ***B01F 13/02*** | (2006.01) |

(52) U.S. Cl.

CPC ..... *B01F 3/18* (2013.01); *B01F 5/10* (2013.01); *B01F 5/102* (2013.01); *B01F 5/106* (2013.01); *B01F 5/24* (2013.01); *B01F 13/0266* (2013.01)

(58) Field of Classification Search

CPC ..... B01F 13/0266; B01F 3/18; B01F 5/10; B01F 5/106; B01F 5/102; B01F 5/24

USPC ..... 366/101, 136, 137

See application file for complete search history.

(56) References Cited

U.S. PATENT DOCUMENTS

| | | | | | |
|---|---|---|---|---|---|
| 2,125,913 | A * | 8/1938 | Goebels | B01F 13/025 | 222/195 |
| 2,590,872 | A * | 4/1952 | Kraft | C10G 25/06 | 196/46 |
| 3,106,385 | A * | 10/1963 | Arthur | B01F 5/242 | 34/102 |
| 3,148,864 | A * | 9/1964 | McClellan | B65G 53/22 | 366/107 |
| 3,179,378 | A * | 4/1965 | Zenz | B65G 53/22 | 118/DIG. 5 |
| 3,448,965 | A * | 6/1969 | Young | B01F 3/18 | 366/101 |
| 3,583,681 | A * | 6/1971 | Brown | B01F 5/245 | 366/107 |
| 3,636,856 | A * | 1/1972 | Neel | A23B 9/32 | 366/136 |
| 3,671,018 | A * | 6/1972 | McKibben | B01F 13/0255 | 366/107 |

(Continued)

*Primary Examiner* — Tony G Soohoo

(74) *Attorney, Agent, or Firm* — Vorys, Sater, Seymour and Pease LLP

(57) ABSTRACT

A system for mixing a fine bulk material including means defining a looped passageway including a vertically disposed, laterally enlarged section having a frusto-conically configured, lower outlet portion; means for injecting a fluid under pressure into an upper segment of such frusto-conically configured lower outlet portion to fluidize material therein; means for injecting a fluid under pressure into a lower segment of such frusto-conically configured lower portion to fluidize material therein; and means for injecting a fluid under pressure in said passageway downstream of said lower outlet portion sufficient to induce the flow of fluidized material through said passageway to an upper end of such enlarged section.

25 Claims, 2 Drawing Sheets

(56) References Cited

U.S. PATENT DOCUMENTS 3,807,705 A * 4/1974 Humkey ..... B01F 13/0244 366/101
3,862,707 A * 1/1975 Reiter ..... B65D 88/72 222/195
3,973,757 A * 8/1976 Klein ..... B01F 13/0288 366/101
4,002,325 A * 1/1977 Herfeld ..... B01F 13/0244 34/586
4,042,220 A * 8/1977 Humkey ..... B01F 13/0244 366/101
4,408,889 A * 10/1983 Peschl ..... B01F 5/24 222/199
4,491,419 A * 1/1985 Ahrens ..... B01F 13/0288 366/101
4,534,653 A * 8/1985 Courtay ..... B01F 13/0288 222/195
4,662,543 A * 5/1987 Solimar ..... B65D 88/706 222/195
5,017,053 A * 5/1991 Sisk ..... B01F 13/0255 366/101
5,139,175 A * 8/1992 Krysel ..... B65D 88/706 137/860
5,145,253 A * 9/1992 Paul ..... B01F 13/0244 366/101
6,186,657 B1 * 2/2001 Fuchsbichler ..... B01F 1/00 366/165.4
6,302,573 B1 * 10/2001 Morimoto ..... B01F 13/0266 366/106
6,609,871 B2 8/2003 Pfeiffer et al.
6,722,822 B2 4/2004 Pfeiffer et al.
6,796,749 B2 9/2004 Pfeiffer et al.
6,964,544 B2 11/2005 Pfeiffer et al.
7,073,985 B2 7/2006 Pfeiffer et al.
7,267,475 B2 * 9/2007 Steele ..... B01F 13/0266 366/101
7,731,411 B2 * 6/2010 Pessin ..... B01F 3/18 366/106
2015/0298076 A1 * 10/2015 Fazekas ..... G06F 17/30861 366/132

* cited by examiner

SYSTEM FOR MIXING/BLENDING FINE BULK MATERIALS

This invention relates to a system for mixing/blending fine bulk materials and more particularly to such a system for recycling such material in a manner including infusing, impelling and accommodating the flow of such material with a fluid.

BACKGROUND OF THE INVENTION

In the prior art, there exist a number of systems for mixing or blending fine bulk materials which generally include a vessel for holding such material and means for conveying such material from a lower end of such vessel to an upper end thereof, resulting in a mixing or blending thereof. Such systems, however, have been found not to be highly effective in sufficiently and economically functioning to mix and/or blend such materials. Accordingly, it is the principal object of the present invention to provide a system for mixing or blending a body of fine bulk material which is highly effective in reducing the back pressure on such body of material thereby facilitating the recirculation of such material.

SUMMARY OF THE INVENTION

The present invention overcomes the deficiencies of the prior art by providing a system for mixing a fine hulk material generally including means for containing a fine bulk material, means for recirculating such material from a lower end of the containing means to an upper end thereof, means disposed in an upper portion of the lower end of the containing means for injecting a flow of fluid into a portion of such material under pressure sufficient to penetrate and fluidize such material therein, means disposed in a lower portion of the lower end of such containing means for injecting a flow of fluid into a portion of the material therein under a pressure sufficient to fluidize material therein and means for injecting a fluid under pressure into the recirculating means for impelling fluidized material received therein, through such recirculating means. In the preferred embodiment of the invention, the means for containing the fine bulk material is provided with a frusto-conically configured lower end funned of an impermeable material, a frusto-conically configured component formed of a permeable material disposed within and coaxially relative to and spaced from the frusto-conically lower end of such containing means, having upper, lower and intermediate annular components providing upper and lower annular chambers therebetween, means for injecting a fluid under pressure into such upper chamber sufficient to penetrate the permeable frusto-conically configured component and fluidize material disposed therein, and means for injecting a fluid under pressure into the lower chamber sufficient to penetrate the permeable frusto-conically configured component and fluidize material disposed therein.

DETAILED DESCRIPTION OF THE PREFERRED EMBODIMENT OF THE INVENTION

Figure 1:
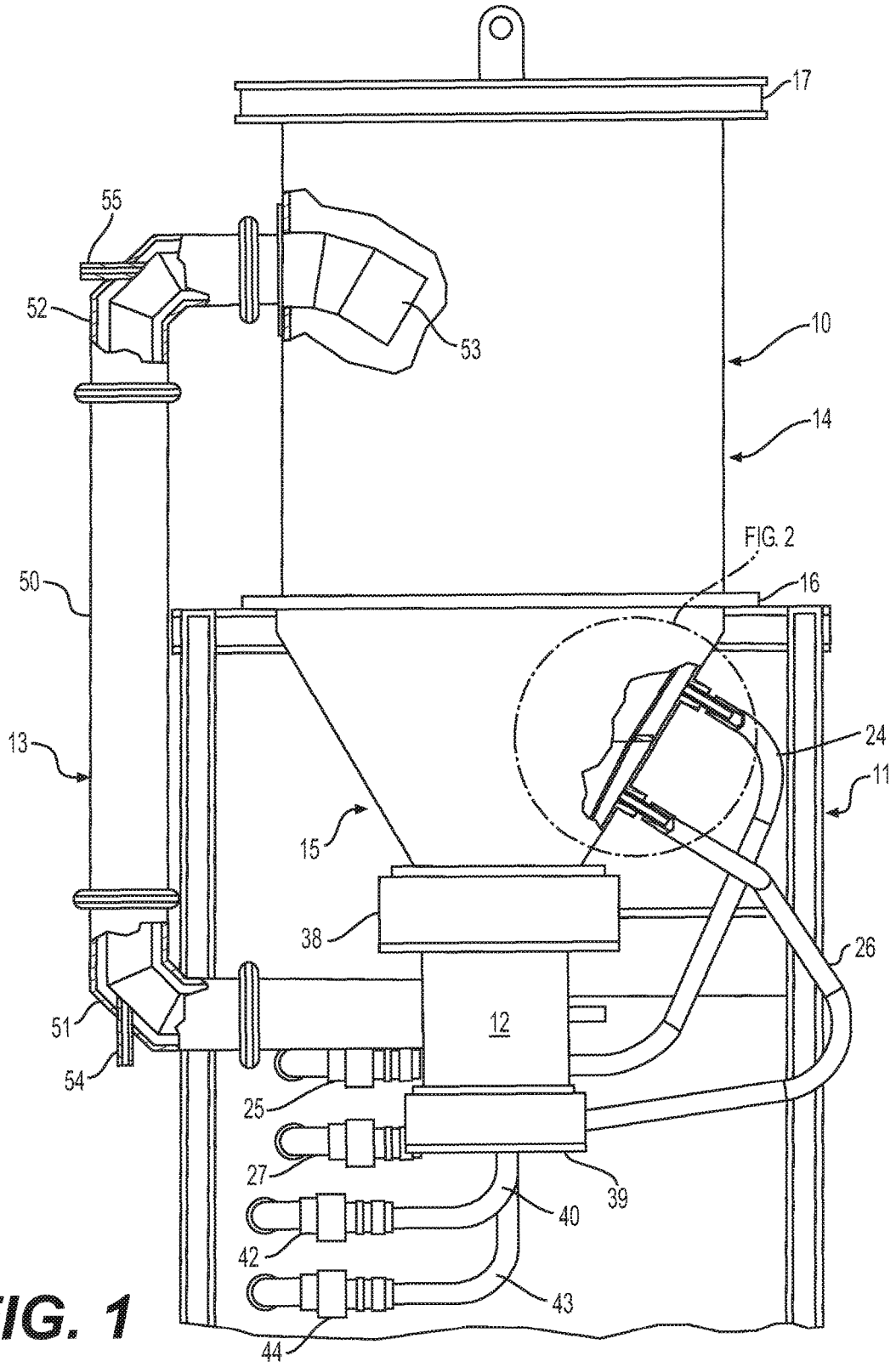
FIG. 1 is an elevational view of a system embodying the present invention, having portions thereof broken away displaying interior constructions thereof.
Figure 2:
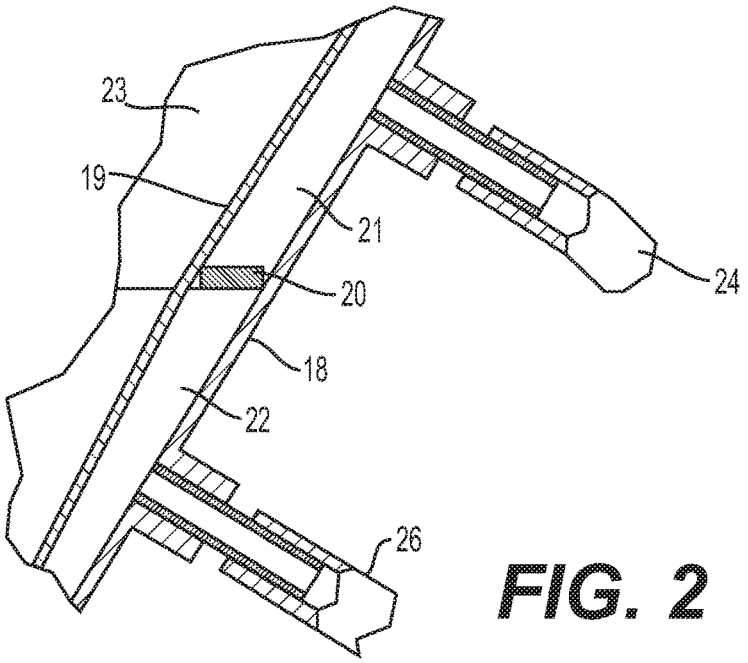
FIG. 2 is an enlarged, fractional view of a portion of the system identified in FIG. 1.

Referring to the drawings, there is illustrated an embodiment of the invention which generally consists of a vertically disposed vessel 10 mounted on a support structure 11, a spool assembly 12 mounted on the lower end of vessel 10 and a recycling assembly 13 intercommunicating the spool assembly with an upper portion of the vessel. Vessel 10 includes an upper cylindrical portion 14 and a depending frusto-conically configured portion 15. The lower end of cylindrical portion 14 is provided an annular flange 16 for seating the vessel on support structure 11, and a cover plate 17 is provided at the upper end thereof which may be removed to load a fine bulk material to be mixed or blended. As best shown in FIG. 2, component 15 includes an outer, frusto-conically configured member 18 formed of an impermeable material, an inner frusto-conically configured member 19 formed of a permeable material disposed coaxially relative to and spaced inwardly from member 18, annular end walls (not shown) disposed between the upper and lower portions of members 18 and 19 and one or more annular wall member 20 disposed in the space between members 19 and 20 and cooperating with the annular end walls thereof to provide upper and lower annular chambers 21 and 22 communicable with inner frusto-conically configured chamber 23 through the interstices of inner, permeable frusto-conically configured member 19, Fluid under pressure may be supplied to annular chamber 21 and through member 19 into the upper end of chamber 23, by means of a fluid line 24 connected to a source of fluid under pressure and provided with a valve 25, and fluid under pressure may be supplied to annular chamber 22 and through permeable member 19 into the lower end of chamber 23 by means of a fluid line 26 connected to a source of fluid under pressure and provided with a control valve 27. Frusto-conically configured member 19 may be formed of a material manufactured for and sold by The Young industries, Inc, of Muncy, Pa. under the trademark TRANSFLOW.

Spool assembly 12 includes a vertically disposed cylindrical member 30 provided with upper and lower annular connecting flanges 31 and 32, a radially disposed conduit 33 mounted on member 30 and communicating at one end thereof with the interior of cylinder 30, and provided with an annular connecting flange 34 at a opposite end thereof. Mounted on the opposite side of cylindrical member 30 is a radially disposed nozzle 35 aligned coaxially with cylindrical member 33. Disposed within cylindrical member 30, coaxially and spaced thereform is a conduit 36 formed of a permeable material, having openings disposed axially with respect to conduit 33 and nozzle 35. Similarly, conduit 33 is provided with a cylindrical member 37 formed of a permeable material disposed axially and spaced from conduit 33, interconnecting permeable member 36 and flange 34.

Disposed between the lower end of frusto-conically configured component 15 of the vessel and cylindrical member 30 is a valve 38 which may be closed during loading of material material to be mixed or blended into the vessel, and opened to allow the flow of fluidized material from component 15 through the spool assembly. Provided on the lower end of cylindrical member 30 is a valve 39 adapted to be closed during recirculation of the material in the vessel for blending and opened following blending for discharging.

Figure 3:
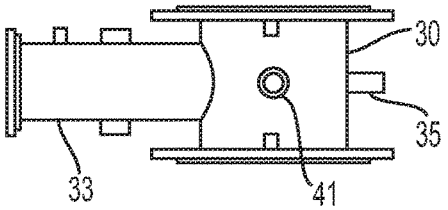
FIG. 3 is an elevational view of a spool assembly forming a component of the lower end of the system shown in FIG. 1.
Figure 4:
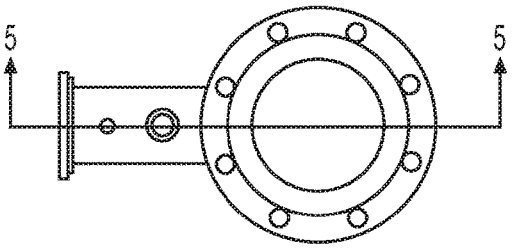
FIG. 4 is a top view of the spool assembly shown in FIG. 3.
Figure 5:
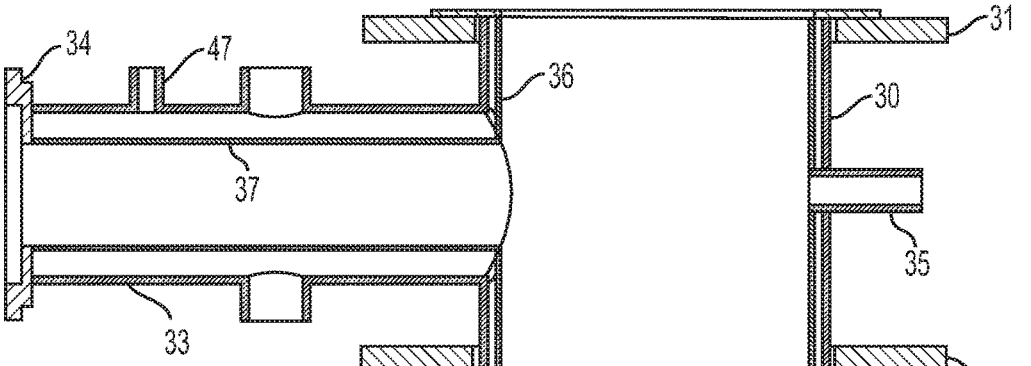
FIG. 5 is an enlarged cross-sectional view of the assembly shown in FIG. 4 taken along line 5-5.

Fluid under pressure is provided to the annular spacing between cylindrical member 30 and permeable cylindrical member 36 by means of a conduit 40 provided with a valve 41, interconnecting a source of fluid under pressure and inlets 41 and 42 as shown in FIG. 3. Such fluid under pressure penetrates permeable member 36 to form a boundary layer along the inner side of permeable member 36 thus minimizing contact of the fluidized material flowing through conduit 30 with such conduit and enhancing the flow therethrough. Similarly, conduit 43 provided with a valve 44, interconnecting a source of fluid under pressure and inlet 47, provides a fluid under pressure to the annular spacing between cylindrical members 33 and 37 and through permeable member 37 to form a boundary layer of fluid along the inner side of permeable member 37, minimizing fluidized material contact with permeable member 37 and correspondingly enhancing the flow of fluidized material therethrough.

Recirculating assembly 13 includes a vertical section 50 a lower elbow section 51 interconnecting a lower end of section 50 and conduit 33, and a upper elbow section 52 interconnecting an upper end of vertical section 50 and a chute 53 mounted on the wall of cylindrical section 14, extending through an opening in such a wall section and connected to a elbow section 52, and having a section disposed within cylindrical portion 14 and communicating with the interior thereof. Each of components 50, 51 and 52 is formed of an outer conduit formed of an impermeable material and an inner conduit formed of a permeable material spaced from such outer conduit, providing a passageway from the spool assembly to the upper end of the vessel. Means are provided for supplying fluid under pressure to the spacing between the inner and outer conduits of assembly 13, which is caused to penetrate the permeable inner conduits thereof, forming a boundary layer of fluid along such passageway, accommodating the flow of fluidized material therethrough. Nozzles 54 and 55 connected to a source of fluid under pressure, arc provided on elbow sections 51 and 52, respectively, for injecting fluid under pressure for impelling fluidized material through the passageway therein, into the upper end of the vessel.

In the use of the system as described to mix or blend a batch of fine bulk material, valves 38 and 39 are closed, cover plate 17 is removed and the material is loaded into the upper end of vessel 10, With such material thus having been loaded and cover plate 17 closed, valve 38 is opened to provide material access through the spool and recirculating assemblies, and suitable valves are opened to provide a boundary layer of fluid along the passageway provided through the spool and recirculating assemblies. Fluid under pressure is then provided through conduit 24, annular chamber 21 and through permeable component 19 to fluidize material in the upper conical portion of space 23 of the vessel. Simultaneously, fluid under pressure is provided through conduit 26, annular chamber 22 and through permeable component 19 to fluidize material in the lower conical space 23 of the vessel. Fluid under pressure injected through nozzles 35, 54 and 55 further function to impel fluidized material received through the lower end of the vessel, through the material passageway provided by the spool and recirculating assemblies, to and into the upper portion of the vessel. The flow of such fluidized material is accommodated by the fluid boundary provided in the passageway through the spool and recirculating assemblies. Such recirculation of material is repeated to provide the desired mixing or blending of the material whereupon the injection of fluid under pressure is discontinued, valve 39 is opened and the mixed or blended material is permitted to gravity flow out of the vessel into a container or through a conveying conduit.

Typically, in seeking to mix or blend a tine bulk material deposited in a vessel by recirculation of such material, such recirculation invariably is precluded by the fact that the back pressure of the conveying system is greater than the head pressure on the deposited material. Such impediment is overcome in the present invention by fluidizing the material in the upper and lower segments of the inner frusto-conically configured component formed of a permeable material, causing it to be drawn into and through the spool assembly and to be impelled through the passageway provided by the spool and recirculating assemblies, lined with a boundary layer of fluid reducing friction and correspondingly enhancing the flow of fluidized material to the upper end of the vessel From the foregoing detailed description, it will be evident that there are a number of changes, adaptations and modifications of the present invention, which come within the province of those persons having ordinary skill in the art to which the aforementioned invention pertains. However, it is intended that all such variations not departing from the spirit of the invention be considered as within the scope thereof as limited solely by the appended claims.

We claim:

1. A system for mixing a fine bulk material, comprising:

a vessel means for containing a fine bulk material;

a spool assembly means connected to a lower end of said vessel for receiving said fine bulk material from said vessel means;

a recirculating conduit means for recirculating said material from said spool assembly means to an upper end of said vessel;

upper injecting means disposed in an upper portion of said lower end of said vessel means for injecting a flow of fluid into a portion of said material under pressure to penetrate and fluidize said material therein;

lower injecting means disposed in a lower portion of said lower end of said vessel means for injecting a flow of fluid into a portion of said material under pressure sufficient to fluidize said material therein;

recirculating conduit injecting means for injecting fluid under pressure into said recirculating conduit means for inducing said fluidize material to flow through said recirculating conduit means; and boundary layer means for providing a boundary layer of fluid within said recirculating conduit means.

2. The system of claim 1 wherein said recirculating conduit injecting means is spaced along a length of said recirculating conduit means for injecting fluid under pressure for inducing flow of said fluidized material disposed therein.

3. The system of claim 1 wherein said recirculating conduit means is a vertically disposed conduit provided with an inlet communicable with said spool assembly means, and having a closeable outlet, and wherein said recirculating conduit injecting means communicates with an interior of said recirculating conduit means, and said recirculating conduit injecting means for injecting fluid under pressure for inducing flow of said fluidized material received therein is mounted on said recirculating conduit means and directed to induce flow within said recirculating conduit means.

4. The system of claim 3 wherein said recirculating conduit injecting means for injecting fluid under pressure into said recirculating conduit means includes a nozzle.

5. The system of claim 3 including a valve disposed in said inlet of said conduit.

6. The system of claim 5 wherein said valve is a slide valve.

7. The system of claim 3 including a valve disposed in said closable outlet of said conduit.

8. The system of claim 7 wherein said valve is a slide valve.

9. The system of claim 1 wherein said upper injecting means disposed in said upper portion of said lower end of said vessel means for injecting a flow of fluid into said portion of said material under pressure sufficient to penetrate and fluidize said material therein includes a frusto-conically configured component formed of permeable material through which said fluidizing material is injected.

10. The system of claim 9 wherein said lower injecting means disposed in said lower portion of said lower end of said vessel means for injecting a flow of fluid into said portion of said vessel means under pressure sufficient to penetrate and fluidize said material includes another frusto-conically configured component formed of permeable material through which said fluidizing fluid is injected.

11. The system of claim 10 wherein said frusto-conically configured components are disposed coaxially and successively.

12. A system for mixing a fine bulk material comprising:

a vessel having a frusto-conically configured lower end formed of an impermeable material;

a frusto-conically configured component formed of a permeable material disposed within, coaxially relative to and spaced from said frusto-conically configured lower end of said vessel, having upper, lower and intermediate annular components spacing said frusto-conically configured components, defining upper and lower annular chambers therebetween;

upper injecting means for injecting a fluid under pressure into said upper chamber sufficient to penetrate said frusto-conically configured component and fluidize material disposed therein;

lower injecting means for injecting a fluid under pressure into said lower chamber sufficient to penetrate said frusto-conically configured component and fluidize material disposed therein;

a spool assembly means connected to a lower end of said vessel;

recirculating conduit means for recirculating fluidized portions of said material emanating from said frusto-conically configured, permeable component to an upper end of said vessel;

recirculating conduit injecting means for injecting fluid under pressure into said recirculating conduit means for inducing said fluidized material to flow through said recirculating conduit means; and a boundary layer means for providing a boundary layer of fluid within said recirculating conduit means thereby facilitating the flow of fluidized material therethrough.

13. The system of claim 12 wherein said recirculating conduit injecting means is spaced along a length of said recirculating conduit means for injecting fluid under pressure therein for inducing the flow of material disposed therein.

14. The system of claim 12 wherein said recirculating conduit means is a vertically disposed conduit provided with an inlet communicable through said spool assembly means with said frusto-conically configured component, formed of said permeable material, and a closable outlet, wherein said recirculating conduit injecting means communicates at an end thereof with the interior of said recirculating conduit means.

15. The system according to claim 14 wherein said recirculating conduit injecting means for injecting fluid under pressure in said recirculating conduit means is provided with a nozzle, functional to inject fluid under pressure through said recirculating conduit injecting means into said recirculating conduit means.

16. The system of claim 14 including a valve disposed in said inlet of said recirculating conduit means.

17. The system of claim 16 wherein said valve is a slide valve.

18. The system of claim 14 including a valve disposed in said outlet of said recirculating conduit means.

19. The system of claim 18 wherein said valve comprises a slide valve.

20. The system of claim 14 wherein said recirculating conduit means includes a vertical component, a lower elbow configured component intercommunicating with said vertical component and said recirculating conduit means and an upper elbow configured component intercommunicating with said vertical component and said vessel.

21. The system of claim 20 wherein said recirculating conduit injecting means for injecting fluid under pressure into said recirculating conduit means for inducing fluidized material received into said recirculating conduit means to flow through said lower elbow configured component.

22. The system of claim 20 wherein said recirculating conduit means includes said recirculating conduit injecting means for injecting fluid under pressure through a vertically disposed portion of said lower elbow configured component and a lower end of said vertical component, functional to induce fluidized material disposed therein to flow, and said recirculating conduit injecting means is configured for injecting fluid under pressure through a horizontally disposed portion of said upper elbow configured component functional to induce fluidized material disposed therein to flow.

23. The system of claim 20 wherein each of said components of said recirculating conduit means includes an inner conduit portion formed of permeable material which communicates with adjoining inner conduit portions of said components to provide a fluidized material passageway from said recirculating conduit means to said vessel, and an outer conduit portion spaced from and encompassing said inner component, formed of impermeable material, and including recirculating conduit injecting means for injecting a fluid under pressure into spacing between said inner and outer conduit portions and through said permeable material to provide said boundary layer of fluid within said inner conduit portions facilitating the flow of fluidized material in said passageway.

24. The system of claim 23 including first and second means connected to said recirculating conduit means for injecting fluid under pressure through said lower elbow component and said upper elbow component through said passageway for inducing fluidized material to flow therethrough.

25. A system for mixing at least one fine bulk material, comprising:

vessel means defining a looped passageway including a vertically disposed, laterally enlarged section having a frusto-conically configured, lower outlet portion, functional to receive, hold and convey said material and a recirculating conduit means;

upper injecting means for injecting a fluid under pressure into an upper segment of said frusto-conically configured, lower outlet portion sufficient to fluidize a portion of said material disposed therein;

lower injecting means for injecting a fluid under pressure into a lower segment of said frusto-conically configured, lower outlet sufficient for fluidizing material in said lower segment;

spool assembly mean connected to a lower end of said vessel;

recirculating conduit injecting means for injecting a fluid under pressure in said passageway downstream of said frusto-conically configured, lower outlet portion and said spool assembly means sufficient to induce the flow of fluidized material through said passageway to an upper end of said laterally enlarged section of said vessel; and boundary layer means for providing a boundary layer of fluid in said passageway between said frusto-conically configured, lower outlet portion and said upper end of said laterally enlarged section of said vessel.

* * * * *